US005299968A

United States Patent [19]

Bennett

[11] Patent Number: 5,299,968

[45] Date of Patent: Apr. 5, 1994

[54] PRIMARY AND SECONDARY TOY FIGURE PAIR WITH INTERCHANGEABLE HAIR SEGMENTS

[75] Inventor: Linda K. Bennett, Marina del Rey, Calif.

[73] Assignee: Mattel, Inc., El Segundo, Calif.

[21] Appl. No.: 10,739

[22] Filed: Jan. 29, 1992

[51] Int. Cl.[5] ..... A63H 3/44; A63H 3/16; A63H 3/00

[52] U.S. Cl. ..... 446/394; 446/98; 446/100; 446/268; 446/372; 446/901

[58] Field of Search ..... 446/97, 98, 99, 100, 446/101, 268, 296, 321, 337, 369, 372, 391, 394, 901

[56] References Cited

U.S. PATENT DOCUMENTS

| | | | |
|---|---|---|---|
| D. 226,101 | 1/1973 | Marcus . | |
| 1,431,482 | 10/1922 | Overholt . | |
| 2,180,340 | 11/1939 | Eisler | 446/268 |
| 3,765,123 | 10/1973 | Terzian | 446/394 |
| 4,027,423 | 6/1977 | Barlow et al. | 446/268 |
| 4,070,790 | 1/1978 | Strongin et al. | 446/394 |
| 4,122,628 | 10/1978 | Crowell et al. | 446/100 |
| 4,197,670 | 4/1980 | Cox . | |
| 4,249,337 | 2/1981 | Edson . | |
| 4,979,924 | 12/1990 | Manger . | |
| 4,993,988 | 2/1991 | Chamberlain | 446/394 |
| 5,041,050 | 8/1991 | Ritchey et al. . | |
| 5,118,318 | 6/1992 | Lorizio | 446/372 X |
| 5,125,863 | 6/1992 | Huspen | 446/268 |
| 5,129,853 | 7/1992 | Bowling . | |

FOREIGN PATENT DOCUMENTS

| | | | |
|---|---|---|---|
| 98514 | 11/1924 | Austria | 446/101 |
| 0347022 | 12/1989 | European Pat. Off. | 446/394 |
| 1020462 | 2/1953 | France | 446/369 |
| 2559676 | 8/1985 | France . | |
| 566160 | 9/1975 | Switzerland . | |
| 2013508 | 8/1979 | United Kingdom . | |

*Primary Examiner*—D. Neal Muir
*Attorney, Agent, or Firm*—Roy A. Ekstrand

[57] ABSTRACT

A primary and secondary toy figure pair include a large primary figure having a plurality of hair fiber segments secured to the head thereof to provide a simulated head of hair. A secondary figure substantially smaller than the primary figure is removably securable to a necklace or other attachment supported upon the primary figure. A plurality of hair locks include attachment tabs which facilitate removable attachment of the hair locks between the head of the primary figure and the secondary figure. A ring support is also securable to the secondary figure and the primary figure to support a secondary figure and provide a ring-like structure which may be worn on the child user's finger as a decorative ring.

10 Claims, 1 Drawing Sheet

PRIMARY AND SECONDARY TOY FIGURE PAIR WITH INTERCHANGEABLE HAIR SEGMENTS

FIELD OF THE INVENTION

This invention relates generally to dolls and toy figures and particularly to those combined in associated pairs or pluralities.

BACKGROUND OF THE INVENTION

Dolls and toys figures have for many years proven to be one of the most consistent and popular types of toys used by children of a broad range of ages. Early simple dolls which were often hand-made or crudely fashioned simply replicated human or animal figures. More modern mass-produced dolls have evolved into the basis of a large segment of the immense toy industry and continue to be broadly popular. Faced with the continuing popularity of dolls and toy figures, practitioners in the art have endeavored to provide a great variety of different types of dolls and toy figures. Thus, such dolls and toy figures have been provided with various forms and shapes, different clothing, articulated limbs, various interactive play patterns, removable hair pieces and wigs, and pluralities of dolls associated in interactive play patterns and so on.

For example, U.S. Pat. No. 5,041,050 issued to Ritchey, et al. sets forth a DOLL HEAD AND DETACHABLE WIG in which a doll head supports a plurality of attachment members preferably formed of a hook and loop fabric together with a removable wig having cooperating attachment pads supported on the interior head receiving portion thereof.

U.S. Pat. No. 4,070,790 issued to Strongin, sets forth a DOLL WITH RELEASIBLY ATTACHED HAIR PIECES in which a doll includes a head having a plurality of recesses formed in the scull portion thereof. A plurality of attachable hair pieces are secured to an intermediate attachment member which is received within the scull recesses of the doll.

U.S. Pat. No. 4,197,670 issued to Cox sets forth a DOLL WITH POUCH in which a large doll defines an abdominal cavity having a removable covering for access thereto together with a small secondary doll figure which is receivable within the cavity to simulate a human pregnancy. Self-adherent patches are located at selected positions on the assembly to provide the doll with attachable bonding between the primary and secondary dolls.

U.S. Pat. No. 226,101 issued to Marcus sets forth a DOLL having a large primary doll defining a rear accessible body cavity in the torso portion thereof. A secondary smaller doll is receivable within the body cavity and removable therefrom.

U.S. Pat. No. 1,431,482 issued to Overholt sets forth a DOLL having a torso and head which receives a plurality of smaller doll figures formed to resemble appendages of the larger doll and which are securable thereto in a removable attachment.

U.S. Pat. No. 4,249,337 issued to Edson sets forth a BREAST FEEDING DOLL SET in which a mother doll is provided with a partially removable garment and defines a breasts having fasteners secured to the tips thereof. A baby doll includes a cooperating fastener secured at the location of the doll's mouth to facilitate attachment between the doll's mouth and the mother doll's breast to simulate breast feeding.

U.S. Pat. No. 4,979,924 issued to Manger sets forth a TOY KIT WITH STUFFED ANIMAL-LIKE FIGURINE HAVING A CHANGEABLE APPEARANCE in which a stuffed animal body receives and supports a plurality of anatomical members such as tail, eyes, ears, etc. in a variety of attachable positions to alter the toy figure's position.

U.S. Pat. No. 5,129,853 issued to Bowling sets forth an ANIMAL TOY HAVING CHANGEABLE CUTTABLE FUR in which an animal toy body is covered with a removable coat of long fur which can be cut and groomed to stylize the figure's appearance and then removed and replaced with another fur coat for cutting in a different manner.

Swiss Pat. No. 566,160 sets forth an INSTRUCTIONAL TOY IN SHAPE OF AN ANIMAL-HAVE HEAD AND LIMBS REMOVABLE FROM AND REPLACEABLE ON BODY in which a toy animal body includes a plurality of attachment pads of a hook and loop fabric variety together with a plurality of appendages and head and tail members which are securable thereto in a variety of configurations.

British Pat. No. 2,013,508 issued to Madrell sets forth a IMPROVEMENTS IN OR RELATING TO DOLLS in which a doll figure defines a plurality of hook and loop fabric attachments on the exterior thereof to which a corresponding plurality of appendages and other members may be attached in a variety of configurations.

French Pat. No. 2,559,676 issued to Ballay, et al. sets forth a DOLL'S HEAD WITH VARIABLE FEATURES in which a doll's head supports a plurality of attachment pads which receive a plurality of anatomical features such as lips, nose, eyes and so forth in a removable attachment.

While the foregoing described prior art devices have provided improved play and amusement value, in many instances, there remains nonetheless a continuing need in the art for evermore improved interesting and amusing dolls and toy figures to satisfy children's needs and demands.

SUMMARY OF THE INVENTION

Accordingly, it is a general object of the present invention to provide an improved doll or toy figure playset. It is a more particular object of the present invention to provide an improved doll or toy figure playset having a more interesting and entertaining interactive play pattern and value connected therewith.

In accordance with the present invention, there is provided a toy figure playset comprises: a primary toy figure having a head and a first plurality of simulated hair fibers secured thereto; a secondary toy figure, substantially smaller than the primary toy figure having a head portion; a hair lock having a second plurality of simulated hair fibers; and cooperating attachment means for removably securing the hair lock to the head portion of the secondary toy figure and the primary toy figure.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
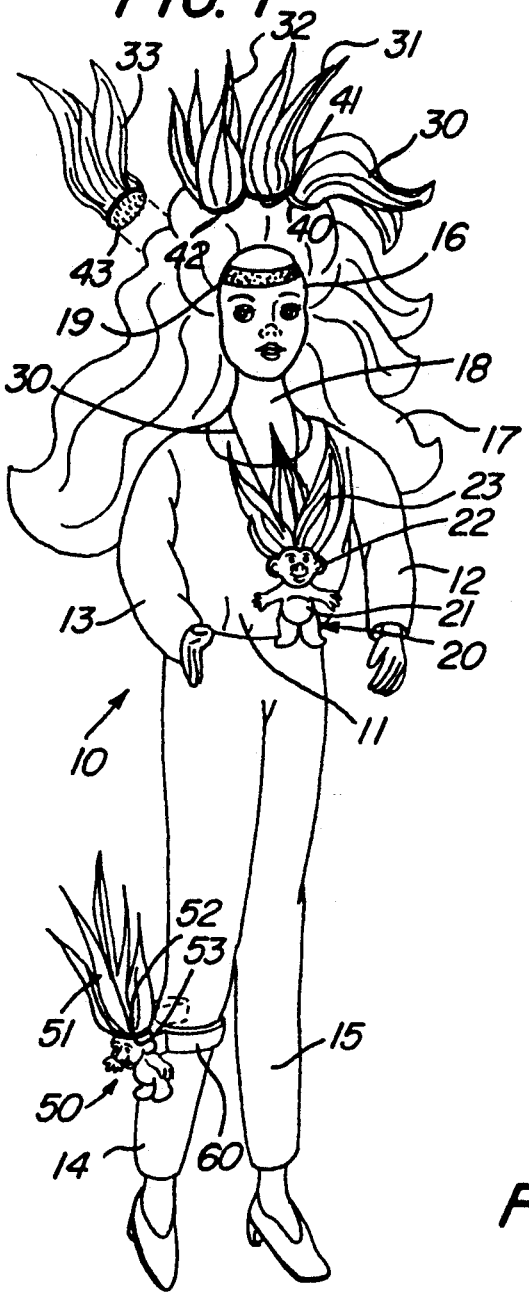
FIG. 1 sets forth a perspective view of a primary and secondary toy figure pair constructed in accordance with the present invention.

FIG. 1 sets forth a front perspective view of a primary and secondary toy figure pair constructed in accordance with the present invention. A primary figure generally referenced by numeral 10 includes a human figure having a body 11, a pair of arms 12 and 13 and a pair of legs 14 and 15 secured thereto in accordance with conventional fabrication techniques. Body 11 further defines an upwardly extending neck 18 which supports a head 16. A head of hair 17 is preferably formed of a plurality of conventional simulated hair fibers rooted to or otherwise secured to head 16 in accordance with conventional fabrication techniques. Head 16 further includes a headband 19 secured to head 16 which is preferably fabricated of a material similar to the loop portion of a conventional hook and loop fabric attachment material. A plurality of removable hair locks 30, 31, 32 and 33 define respective attachment pads 40, 41, 42 and 43. In their preferred form, attachment pads 40 through 43 are formed of the hook portions of conventional hook and loop fabric attachment means. Hair locks 30 through 33 are removably securable to the hair fibers of head of hair 17 or, alternatively, may be secured to headband 19 due to the cooperating action between attachment pad loops 40 through 43 and the fabric material of headband 19.

In accordance with the present invention, a secondary FIG. 20 formed as a fanciful troll-type figure or other appearance characteristic is, by means set forth below in FIG. 3, secured to a necklace 30 which encircles neck 18 of primary FIG. 10. In further accordance with the present invention, secondary FIG. 20 defines a body 21 having a head 22 formed therein. By means set forth below in greater detail, a hair lock 23 is removably securable to head 22. In further accordance with the present invention, hair lock 23 may be removed from head 22 of secondary FIG. 20 and secured to hair 17 or headband 19 of primary FIG. 10 as desired. Additionally, hair locks 30 through 33 may be colored in a variety of different colors and define different lengths and characteristics and may be interchangeably secured to head 22 of secondary FIG. 20. Thus, a play pattern is developed in which the plurality of hair locks are removably securable to hair 17 of primary FIG. 10 and head 22 of secondary FIG. 20. As is also set forth below in FIG. 3 more clearly, secondary FIG. 20 is removable from necklace 30 to provide an alternate play pattern.

A ring support 60 is preferably sized and shaped to be received upon a child's finger and thus worn as a ring or, alternatively, may be secured to either of legs 14 or 15 of primary FIG. 10. To provide further flexibility of the present invention toy figure pair, a secondary figure such as secondary FIG. 50 is removably securable to ring support 60 in accordance with conventional attachment means which may, for example, include hook 27 (seen in FIG. 3). In a similar construction to secondary FIG. 20, secondary FIG. 50 includes a removable hair lock 51 having an attachment pad 52 secured thereto and integral therewith in the manner set forth above for hair locks 30 through 33. Secondary FIG. 50 is constructed in similarity to secondary FIG. 20 and includes a cooperating hair attachment pad 53 which together with attachment pad 52 preferably forms a hook and loop fabric attachment pair for securing hair lock 51 to secondary FIG. 50.

Thus, ring support 60 bearing secondary FIG. 50 and hair lock 51 may be removed from leg 14 and worn by the child user as a decorative ring. When so worn, hair lock 51 may be removed from secondary FIG. 50 and secured to primary FIG. 10 using either headband 19 or hair 17 in the manner described above.

Figure 2:
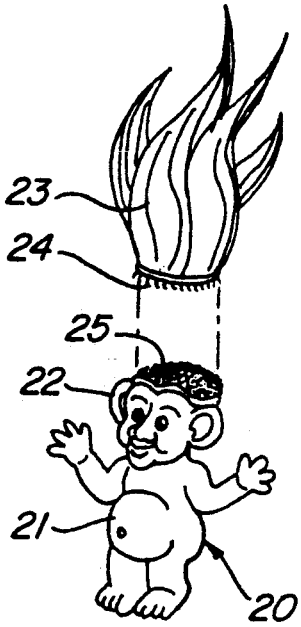
FIG. 2 sets forth a perspective assembly view of the secondary toy figure of the present invention toy figure pair.

FIG. 2 sets forth a perspective assembly view of a secondary figure constructed in accordance with the present invention and generally referenced by numeral 20. As described above in FIG. 1, secondary FIG. 20 includes a body 21 having a head 22 formed in a fanciful caricature such as a troll or the like. It will be apparent to those skilled in the art, however, that secondary FIG. 20 may be fabricated to provide virtually any appearance without departing from the spirit and scope of the present invention. Head 22 supports an attachment 25 which is, in its preferred form, fabricated to provide a loop-type attachment member of the type utilized in conventional hook and loop fastening apparatus. A removable hair lock 23 includes an attachment pad 24 which in its preferred form comprises a plurality of hook type attachment members cooperating with attachment 25 to form a hook and loop removable attachment means for securing hair lock 23 to head 22 of secondary FIG. 20.

Thus, in accordance with the above-described play pattern of the present invention, hair lock 23 may be worn upon secondary FIG. 20 using the attachment of attachment pad 24 and attachment 25 or, alternatively, hair lock 23 may be removed from secondary FIG. 20 and utilized in any of the above-described play patterns. By way of further alternative, other hair locks such as hair locks 30 through 33 may be substituted for hair lock 23 and secured to secondary FIG. 20.

Figure 3:
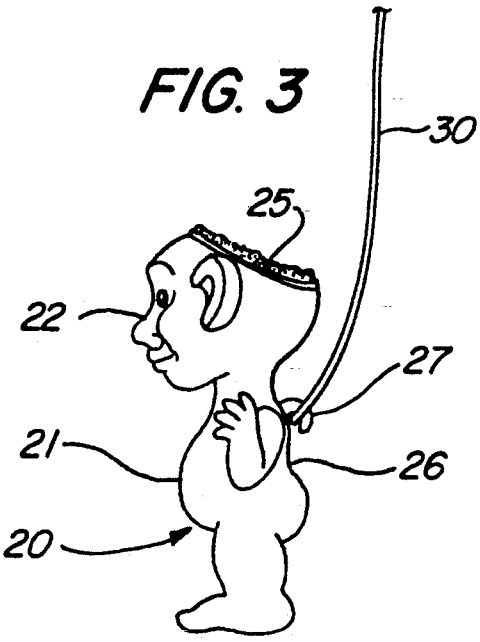
FIG. 3 sets forth a side view of the secondary toy figure of the present invention toy figure pair.

FIG. 3 sets forth a side view of secondary FIG. 20 secured to necklace 30. As described above and as is better seen in FIG. 1, necklace 30 is worn about neck 18 of primary FIG. 10. Thus, secondary FIG. 20 includes a body 21 defining a head 22 and a back portion 26. An attachment hook 27 extends rearwardly from back 26 to provide a removable attachment to necklace 30. Attachment 25 is, as described above, formed of a loop-type fabric attachment structure for receiving and securing a selected one of the above-described hair locks. Hook 27 is shown for illustrative purposes to provide attachment to necklace 30 in a removable fashion. It will be apparent to those skilled in the art, however, that a great variety of attachment mechanisms may be utilized for removably securing secondary FIG. 20 to necklace 30 without departing from the spirit and scope of the present invention.

Thus, in accordance with the present invention primary and secondary toy figure pair, the secondary figure is removably combinable with the primary figure to provide alternative relationships such as a necklace pendent or ring supported member. In addition, the hair locks of the primary figure and the secondary figure are interchangeably securable to provide an interactive play pattern in which the hair locks may be used to alter the appearance of both the primary and secondary figure as the child user wishes.

Thus, what has been shown is a novel, interactive toy figure pair having an unusual interplay relationship in which hair segments are interchangeable and in which the toy figures may be combined or separated in a variety of relationships.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure playset comprising:
- a primary toy figure having a head and a first plurality of simulated hair fibers secured thereto;
- a secondary toy figure, substantially smaller than said primary toy figure having a head portion;
- a hair lock having a second plurality of simulated removable hair fibers with cooperating attachment means forming a base for said hair lock;
- a headband featuring a second cooperating attachment means for attaching said hair lock to said primary figure by said base and
- additional second cooperating attachment means attached to said secondary toy figure head portion for removably securing said hair lock to either of said head portion of said secondary toy figure and said primary toy figure.

2. A toy figure playset as set forth in claim 1 wherein said head portion of said secondary toy figure defines an upper surface and wherein said cooperating attachment means include:
- a first attachment pad supported on said upper surface; and
- a second attachment pad coupled to said second plurality of simulated hair fibers of said hair lock.

3. A toy figure playset a set forth in claim 2 wherein said first attachment pad forms a loop portion of a hook-and-loop attachment and said second attachment pad forms a hook portion of a hook-and-loop attachment.

4. A toy figure playset as set forth in claim 3 further including a necklace receivable upon said primary toy figure and wherein said secondary figure includes means for attaching said secondary figure to said necklace.

5. A toy figure playset as set forth in claim 4 further including a ring member, wearable upon a user's finger for supporting said secondary toy figure.

6. A toy figure playset as set forth in claim 1 further including a necklace receivable upon said primary toy figure and wherein said secondary figure includes means for attaching said secondary figure to said necklace.

7. A toy figure playset comprising:
- a primary toy figure having a head and a plurality of hair fibers secured thereto;
- a secondary toy figure, substantially smaller than said primary toy figure, having a head defining an upper surface having a loop attachment pad supported thereon;
- a necklace receivable upon said primary toy figure;
- means for securing said secondary toy figure to said necklace including a hook extending from said secondary toy figure;
- a plurality of hair locks each having a hook attachment pad and each being attachable to either of said loop attachment pad of said secondary toy figure of said hair fibers of said primary toy figure.

8. A toy figure playset as set forth in claim 7 wherein said primary toy figure further includes a headband for attachment of said hair locks.

9. A toy figure playset as set forth in claim 7 wherein including a ring member, wearable upon a user's finger for supporting said secondary toy figure.

10. A toy figure playset comprising:
- a primary toy figure having a head and a first plurality of simulated hair fibers secured thereto;
- a secondary toy figure, substantially smaller than said primary toy figure having a head portion with a rear hook means;
- a hair lock having a second plurality of simulated hair fibers;
- a ring member, wearable upon a user's finger for supporting said secondary toy figure by engaging said hook means;
- cooperating attachment means for removably securing said hair lock to said head portion of said secondary toy figure and said primary toy figure.

* * * * *